US005958483A

United States Patent [19]

Anders et al.

[11] Patent Number: 5,958,483

[45] Date of Patent: Sep. 28, 1999

[54] PACKAGE FOR COLLECTING AND SEGREGATING PARTICULATE FOOD DEBRIS

[76] Inventors: Irving Anders, 54 Crossway, Scarsdale, N.Y. 10583; Bruce Anders, 4919 Winnequah Dr., Monona, Wis. 53716

[21] Appl. No.: 08/999,968

[22] Filed: Oct. 25, 1997

[51] Int. Cl.[6] ..... B65D 5/56; B65D 25/14; B65D 33/00; B65D 85/00

[52] U.S. Cl. ..... 426/112; 426/124; 426/123; 383/210; 383/109; 229/117.27; 209/373; 209/374; 209/680; 209/417

[58] Field of Search ..... 426/112, 115, 426/124, 123; 209/235, 259, 680, 370, 373–377, 417; 383/109, 210, 35, 211; 229/117.27, 117.29–117.35

[56] References Cited

U.S. PATENT DOCUMENTS

| | | | |
|---|---|---|---|
| 1,198,938 | 9/1916 | McClarrinon | 209/259 |
| 1,965,040 | 7/1934 | Kelly | 209/370 |
| 2,286,465 | 6/1942 | Clement | 383/35 |
| 2,412,547 | 12/1946 | Waters | 229/117.32 |
| 2,493,337 | 1/1950 | Buttery | 229/117.32 |
| 3,083,889 | 4/1963 | Christensson | 229/117.35 |
| 3,550,833 | 12/1970 | Rahenkamp | 229/117.32 |
| 3,561,667 | 2/1971 | Saltman | 229/117.34 |
| 3,821,426 | 6/1974 | Slone | 426/124 |
| 4,503,559 | 3/1985 | Warnke | 426/112 |
| 4,549,657 | 10/1985 | McMartin | 383/210 |
| 4,759,642 | 7/1988 | Van Erden et al. | 383/210 |
| 4,795,270 | 1/1989 | Hgyden | 383/210 |
| 4,889,619 | 12/1989 | Lynch | 209/373 |
| 4,942,277 | 7/1990 | Narberes | 209/235 |
| 4,963,374 | 10/1990 | Brandel et al. | 426/112 |
| 4,997,104 | 3/1991 | Pohl | 229/117.34 |
| 5,215,196 | 6/1993 | Valls | 209/417 |
| 5,352,466 | 10/1994 | Delonis | 383/210 |
| 5,779,894 | 7/1998 | Martensson | 426/112 |
| 5,839,648 | 11/1998 | Brigand et al. | 383/210 |

FOREIGN PATENT DOCUMENTS

| | | | |
|---|---|---|---|
| 2028802 | 4/1992 | Canada | 426/112 |
| 275350 | 7/1988 | European Pat. Off. | 426/112 |

*Primary Examiner*—Steven Weinstein

[57] ABSTRACT

In a preferred embodiment, a system for collecting and segregating particulate food debris from the whole pieces in a packaged food product, and a system to facilitate and ease the opening of the sealed plastic/cellophane/other packaging material within an outer cardboard food box, including: an inner bag; a system of small filter holes perforating the bottom of the inner bag; an outer bag adhered thereon; a system where the composite inner and outer bags are adhered to the inside and toward the top of the cardboard box, in order to maintain a food debris collection pocket at the base of the two-bag system; two gripping devices, of a style/type to include but not limited to, a pull-ring or pull-tab; and a system for affixing the gripping devices directly opposite one another on the outside and at the top of the sealed composite double-bag packaging material, to facilitate breaking the plastic packaging system's hermetic seal.

2 Claims, 5 Drawing Sheets

PACKAGE FOR COLLECTING AND SEGREGATING PARTICULATE FOOD DEBRIS

BACKGROUND OF THE INVENTION

1. Field of the Invention.

The present invention relates to food boxes generally, and, more particularly, but not by way of limitation, to cereal boxes, to a system and method for achieving either of, or both of, the two following purposes: first, for collecting the debris and small crumbs of brittle boxed foods in the base of the food packaging, thereby separating such debris from the remainder of the whole pieces of the boxed food; and second, to provide a means to facilitate and ease the opening of the sealed plastic/cellophane/other packaging material within the outer cardboard box.

2. Background Art.

Dried foods packed in sealed plastic bags, housed inside rigid cardboard boxes, such as cereal and potato chips, are prone to crumble and disintegrate during manufacture, packaging, storage and transport of the food within the plastic bag. The general result of this crumbling process is a collection of crumbs, powder and debris, ranging in size from small particles to fine dust, that, over time, gravity forces to congregate at the base of the food product's upright-stored packaging box. This debris can contaminate the remaining portions of the whole pieces of food product when the food product is poured from the box for consumption, particularly when the box of food materials is nearly empty.

Another common characteristic of present conventional plastic packaging systems is that the sealed inner plastic bag is very difficult to open, as the seal of the plastic bag must typically be opened by grasping with difficulty the inner plastic bag and then either ripping or tearing the sealed sheets apart without effective hand-grips, or by cutting the packaging bag using a sharp implement.

Accordingly, it is a principle object of the present invention to provide a system and method for collecting and segregating this debris from the corpus of the whole pieces in the packaged food product for disposal or other use.

It is a second principle object of this invention to provide a system and method to facilitate and ease the consumer's necessary act of breaking by hand the plastic packaging system's hermetic seal when opening the plastic food bag for the first time.

It is further the object of this invention to be designed and implemented in such a manner that the customary hermetic seal of the box's inner plastic, cellophane, or other synthetic seal, used to insulate and protect the food from outside contaminants, is maintained.

It is another object of the invention to provide such system that can be economically constructed.

It is another object of the invention to provide such system that can be retrofitted, to the maximum extent practicable, to existing standard boxed food-packaging systems.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, two systems: a double-bagging system to create a "food debris collection pocket", and an "easy opening pull-ring or pull-tab system".

First, an "inner bag", which holds the food product, is perforated on the bottom with small filter holes, which allow particle debris to pass through. A slightly larger, and vertically longer "outer bag", is adhered to the inner bag, and forms a "food debris collection pocket" at the base of the two-bag system, which allows the particulate food debris to be collected and separated from the whole pieces of food. The two-bagged system is adhered to the inside and toward the top of the cardboard outer box, suspended within the cardboard box, thereby creating and maintaining the debris collection pocket at the base of the box.

Second, two gripping devices, which could preferably be pull-rings or tabs, are affixed to the outside of the outer bag, at points immediately below the top of the sealed plastic double-bags. A consumer can easily grip these pull-rings/tabs and pull them away from one another, thereby facilitating the act of breaking the conventional seal on a plastic bag of sealed food for the first time.

BRIEF DESCRIPTION OF THE DRAWINGS

Understanding of the present invention and the various aspects thereof will be facilitated by reference to the accompanying drawing figures, submitted for purposes of illustration only, and not intended to define the scope of the invention, on which:

FIG. 4A also depicts the glue/adhesive material (13) that affixes the pull-rings/tabs to the outside walls of the composite double-bagged system.

FIG. 5 displays the double-bagged system (9)

Figure 1:
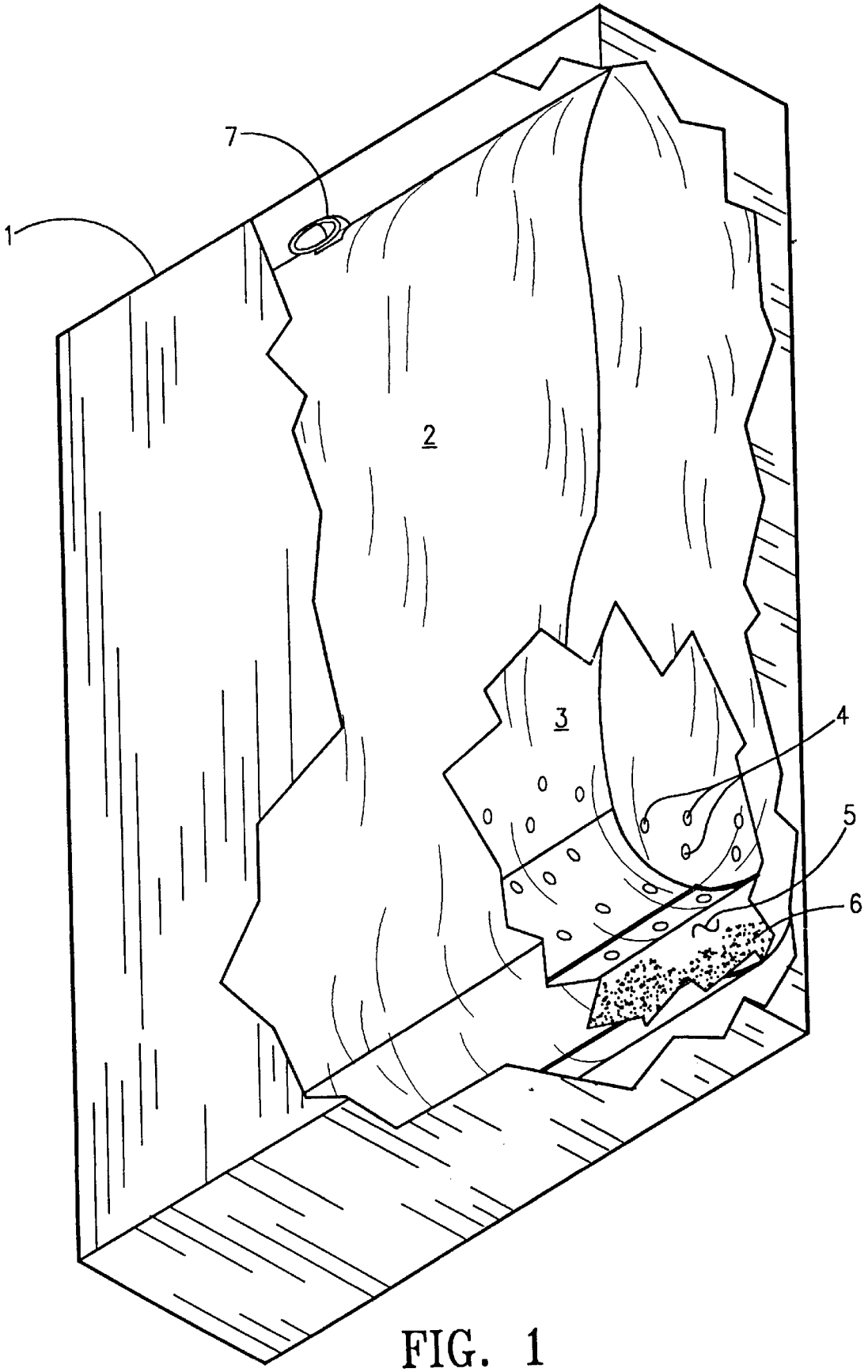
FIG. 1 depicts a cutaway, three-dimensional view of the entire concept and design of the present invention, displaying the following: the outer box (1), typically cardboard; the outer bag (2), as affixed to, and suspended within, the outer box; the inner bag (3) with small filter holes (4), the food debris collection pocket (5) created between the inner perforated and outer whole bags that collects the particulate food debris (6), and the easily graspable pull rings/tabs (7) at the top rim of the composite double bagged system, located on opposite sides of the hermetically sealed strip.

and the location of the glue droplets (14) that hang or suspend the double-bagged system upright within the cardboard box. Suspension in this fashion allows for the creation and maintenance of the food debris collection pocket (5), into which the the filter holes (4) allow particulate food debris (6) to pass and collect. Also pictured are the pull-rings/tabs (7).

DETAILED DESCRIPTION OF THE PREFERRED EMBODIMENTS

Reference should now be made to the drawing figures, on which similar or identical elements are given consistent identifying numerals throughout the various figures thereof, and on which parenthetical reference to figure numbers direct the reader to the view(s) on which the element(s) being described is (are) best seen, although the element(s) may be seen also on other views.

The present invention embodies a double-bagging system to create a "food debris collection pocket", and an "easy opening pull-ring or pull-tab system", as described below. See FIG. 1 for an overview of the concept and design of these two systems.

Figure 2:
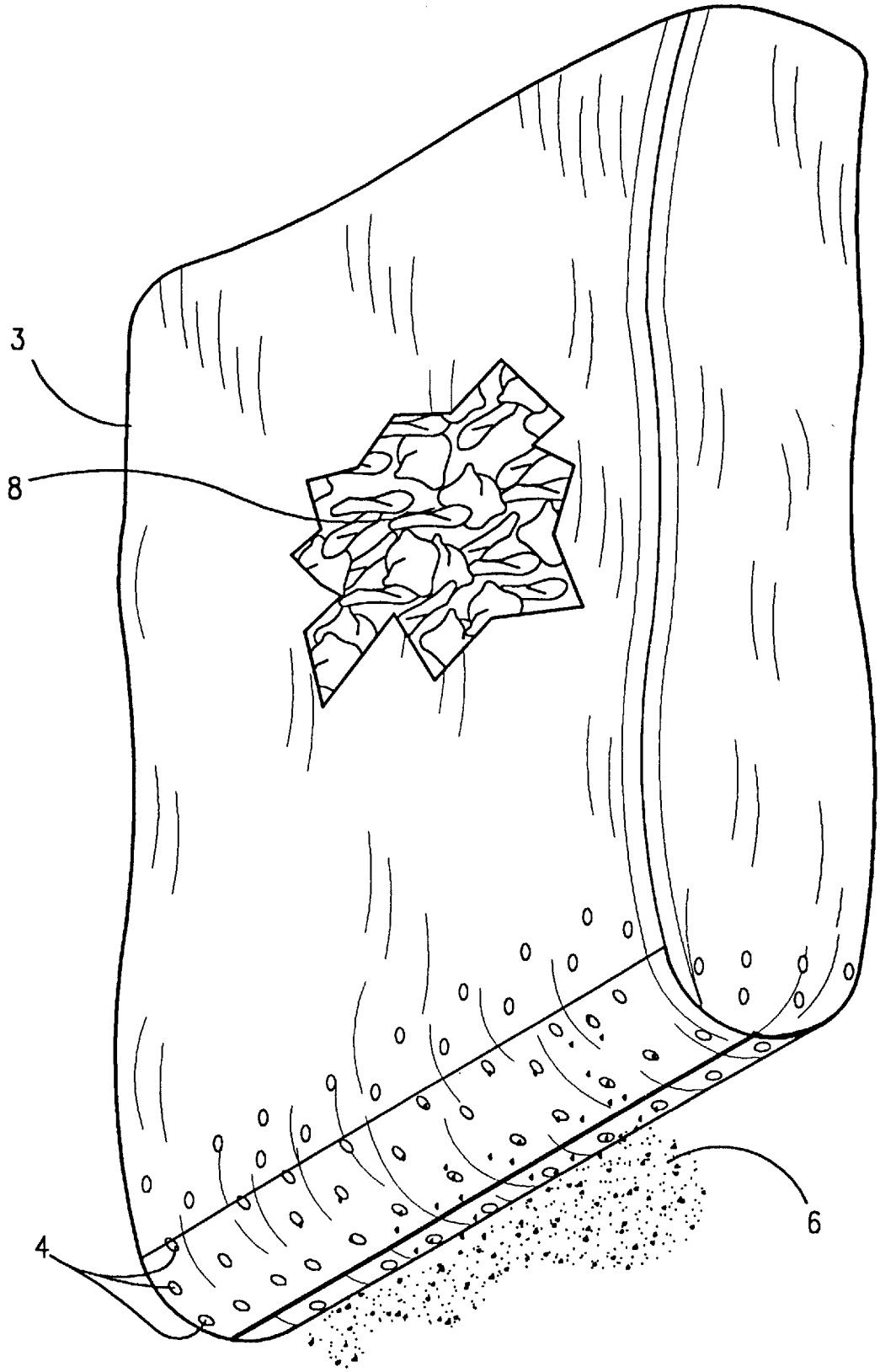
FIG. 2 displays the inner bag (3), which holds the whole food pieces (8). The filter holes (4) are located at the base of the inner bag, allowing for the particulate food debris (6) to pass through and be collected by the food debris collection pocket.

An "inner bag", made of conventional plastic/cellophane/other packaging material, contains and holds the food product (see FIG. 2). The inner bag is perforated on the bottom and on the lower section of the sides with small filter holes. These holes are of a size large enough to allow particle debris to pass through, but are small enough to not allow passage of larger, usable pieces of the food product.

The inner bag resides inside, and is affixed to, an "outer bag" of slightly greater dimensions, except that the length of the outer bag exceeds that of the inner bag by a small percentage of the height of the inner bag, typically one to three inches, depending on the size of the food container. The vertically longer outer bag, when snugly surrounding the bottom-perforated inner bag, results in the formation of a "food debris collection pocket" at the base of the two-bag system (See FIGS. 1 and 3). This pocket, located outside the base of the inner bag and inside the base of the outer bag, allows the particulate food debris to be collected and separated from the whole pieces of food.

Figure 3:
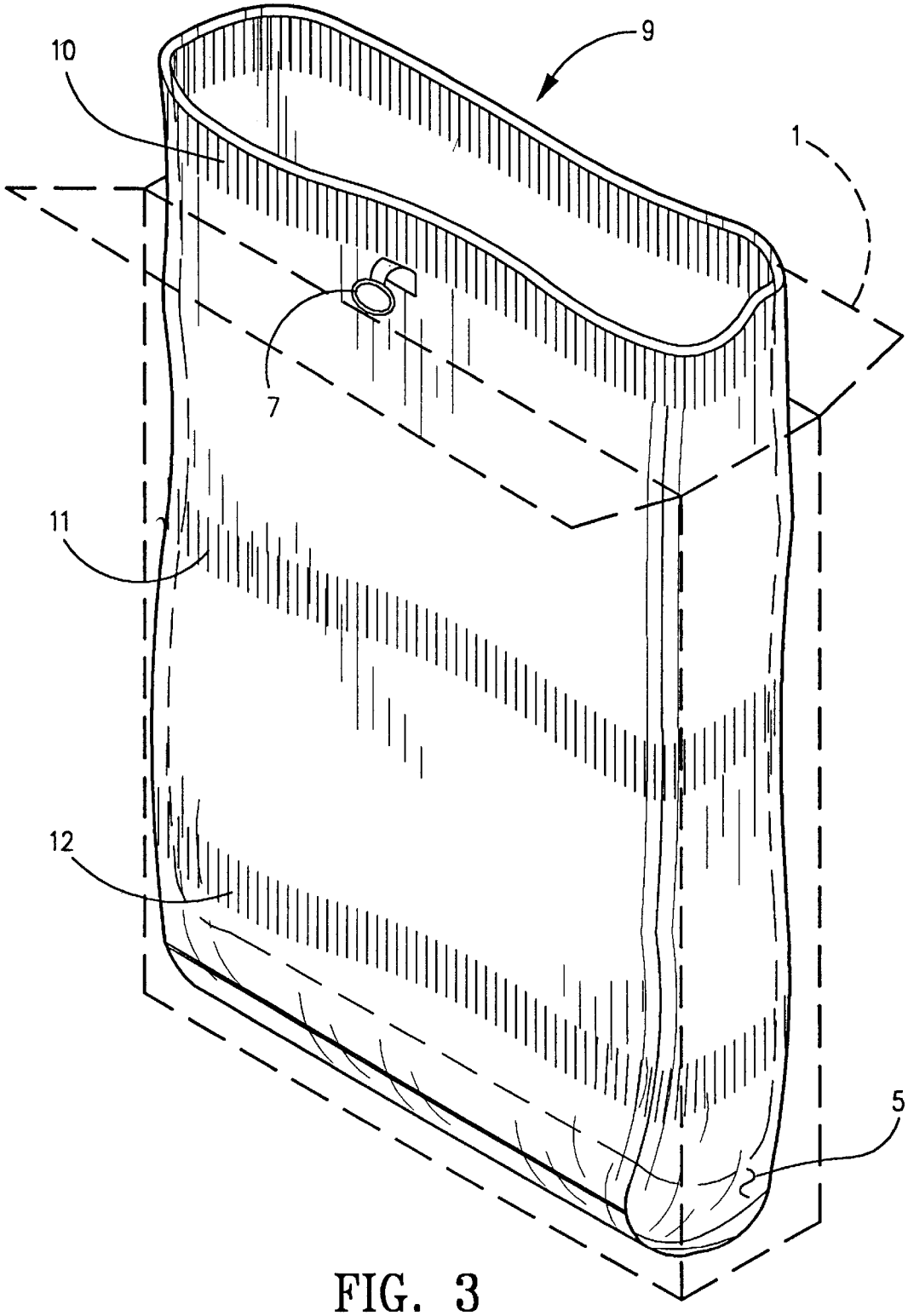
FIG. 3 depicts the method by which the inner and outer bags, together the double-bagged system (9) are adhered together by a gluing/heat-sealing system, or equivalent means, by means of an appropriate number of horizontal rings or bands of sealant/attachment. Displayed are the uppermost sealant ring (10), the middle sealant ring(s) (11), bottommost sealant ring (12) and the resultant food debris collection pocket (5).

The two bags are adhered together by a gluing/heat-sealing system, or equivalent means, by means of an appropriate number of horizontal rings or bands of sealant/attachment (See FIG. 3). The uppermost horizontal sealant/attachment ring affixes the rims of the two bags together such that they are flush and inseparable. The bottommost horizontal sealant/attachment ring affixes the bases of the two bags together at a vertical location somewhat above the perforated base of the inner bag. Between the uppermost and bottommost sealant/attachment rings are the minimum number of middle rings necessary to ensure the two bags remain rigidly affixed; typically, between zero and two such middle sealant/attachment rings are required to adhere rigidly together the two bags, depending upon the size of the food container. The result of these sealant/attachment rings is to adhere the rims of the two bags together flush at the bag tops, and adhere the bodies of the two bags together inseparably.

Figure 5:
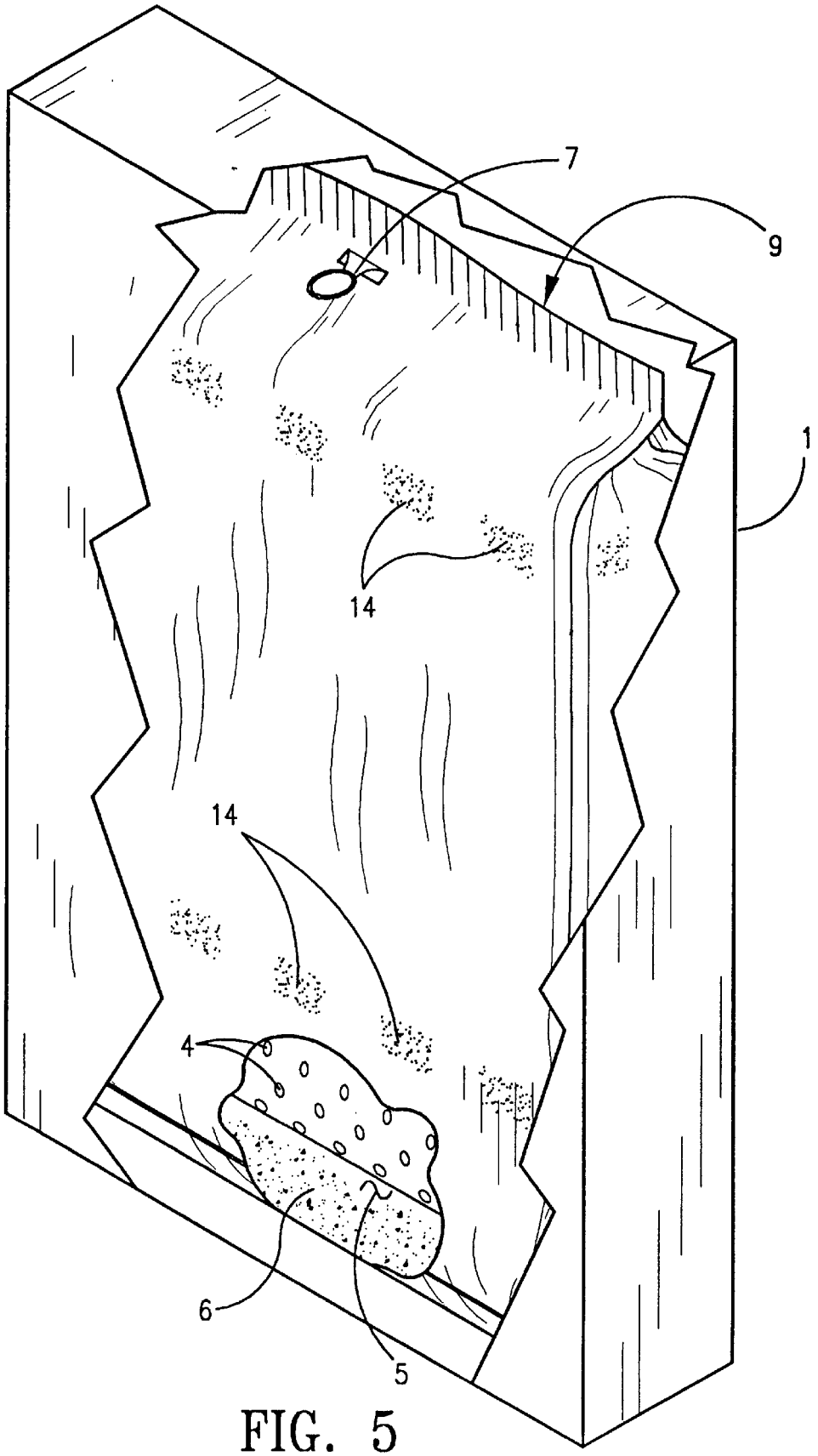
FIG. 5 depicts the method by which the double-bagged system is attached, by glue or equivalent sealant/attachment material, to the inside and toward the top of the cardboard box, in a fashion such that the plastic two-bagged system is attached to, and inseparable from, the inside of the cardboard box.

The plastic composite two-bagged system is adhered by glue, or equivalent sealant/attachment material, to the inside and toward the top of the cardboard box, in a fashion such that the plastic two-bagged system is attached to and inseparable from the inside of the cardboard box (see FIG. 5). The purpose of such adhesion is to hang the composite two-bagged packaging system suspended upright within the cardboard box, thereby creating and maintaining the debris collection pocket at the base of the box. The adhesion is achieved through use of an appropriate number of drops of gluing material, or equivalent substance, which are applied to the composite two-bagged system, and which affix the plastic/cellophane/other packaging material to the upper rim of the cardboard box.

The total height or vertical length of the composite two-bagged system exceeds, by an appropriate dimension, that of the cardboard box, and the point of affixation on the composite two-bagged system is at a point a small percentage of the length of the composite two-bagged system down from its rim (See FIG. 5). Thus, sufficient excess double-bagged plastic packaging material exists, above the point where the two bags are adhered to the box, to allow the upper rims of the composite double-bagged packaging system to be rolled down by a consumer, in order to preserve the freshness of the food product.

Figure 4A:
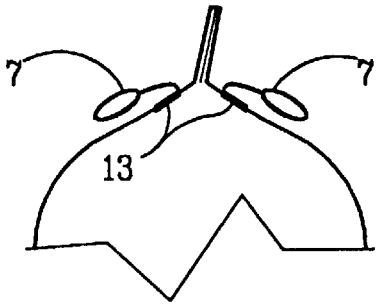
FIG. 4A depicts a side view of the two pull-rings/tabs (7), and their vertical location on the system at the top of the double-bagged system, at a point where a consumer can easily grasp them and pull them apart, breaking the conventional hermetic seal at the top of the plastic/cellophane/other packaging material.
Figure 4B:
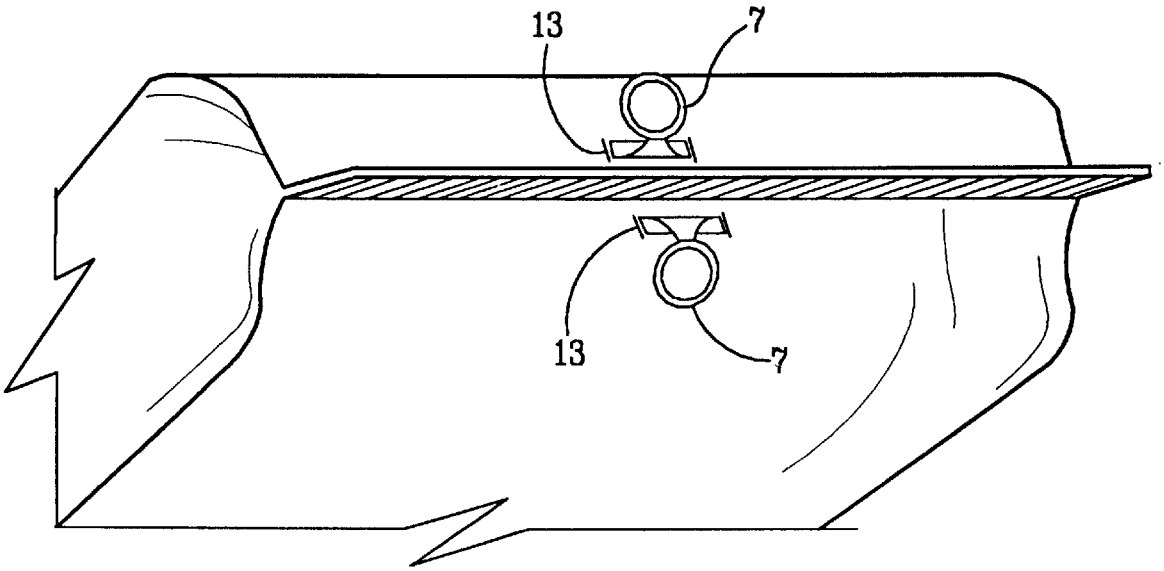
FIG. 4B depicts the same items, but from a top view.

Located on the outside and at the top of the sealed composite double-bag packaging material, and affixed to the outside of the outer bag, at a point above the point where the double-bag packaging plastic system is affixed to the inside of the cardboard box, are affixed two gripping devices, of a style/type to include but not limited to, a pull-ring or pull-tab (see FIG. 4A and 4B. Note that a pull-"ring" is depicted in FIG. 4A and 4B, but that a pull-"tab", or equivalent device, can be substituted). These two gripping devices allow the consumer an easily gripped unit that can be grasped with the fingers and pulled away from one another, thereby facilitating the act of breaking the conventional glued/heat-sealed hermetic seal, and pulling apart the opposing sealed plastic bagsides, when opening the plastic package for the first time.

What is claimed is:

1. a package for collecting and segregating particulate food debris of a size from small particles to fine dust from whole pieces of food comprising:

a hermetically sealed inner bag made of plastic packaging material, which contains and holds whole pieces of food;

a plurality of whole pieces of food contained in said inner bag; said whole pieces of food being prone to crumble and disintegrate to said particulate food debris during manufacture, packaging and transport of said whole pieces of food within said inner bag;

a number of small filter holes perforating the bottom of the inner bag, which allows said particulate debris to pass through the inner bag, but does not allow the passage of said whole pieces of food;

an outer bag made of plastic packaging material; said outer bag surrounds the inner bag by slightly greater dimensions, except that the length of the outer bag exceeds that of the inner bag by a small percentage of the height of the inner bag; said outer bag having a non-perforated, bottom, said two bags being adhered together, the inner bag inside the outer bag, by means of a number of horizontal rings or bands of sealant between said bags sufficient to ensure the two bags remain rigidly affixed to each other to form a sealed composite inner and outer two bag system, and sufficient such that the portion of the length of the outer bag that exceeds the inner bag extends below the perforated bottom of the inner bag and includes the non-perforated outer bag bottom, said portion of the outer bag including the non-perforated outer bag bottom which extends below the perforated bottom of the inner bag defines a food debris collection pocket at the base of the composite two-bag system, which allows the particulate food debris to be collected in the non-perforated outer bag bottom and separated from the whole pieces of food in the inner bag, but that maintains all of the food product within a hermetic seal said package further comprising a cardboard box wherein the composite inner and outer bags are adhered to the inside and toward the top of the cardboard box sufficient to maintain the composite inner and outer bags suspended upright within the cardboard box such that the food debris collection pocket is created and maintained at the base of the cardboard box.

2. The package of claim 1, wherein the package further comprises two gripping devices, each gripping device is affixed to a respective outside surface of the outer bag, with each gripping device directly opposite one another on the outside of the composite two bag system and at the top thereof at a location to facilitate breaking by hand the hermetic seal when opening the composite bags system for the first time by pulling the two gripping devices away from each other.

* * * * *